US006487784B1

(12) United States Patent
Powers

(10) Patent No.: US 6,487,784 B1
(45) Date of Patent: Dec. 3, 2002

(54) PORTABLE DRAWING BOARD FOR ART STUDENTS

(76) Inventor: Jayson J. Powers, P.O. Box 1538, Hemingway, SC (US) 29554

( * ) Notice: Subject to any disclaimer, the term of this patent is extended or adjusted under 35 U.S.C. 154(b) by 46 days.

(21) Appl. No.: 09/607,064

(22) Filed: Jun. 29, 2000

(51) Int. Cl.[7] ..... B43L 13/14
(52) U.S. Cl. ..... 33/437; 33/432; 33/1 K
(58) Field of Search ..... 33/430, 432, 433, 33/434, 437, 443, 447, 448, 450, 446, 441, 438, 435, 1 K, 1 AA, 18.3; 312/231

(56) References Cited

U.S. PATENT DOCUMENTS

| | | | | | |
|---|---|---|---|---|---|
| 308,040 | A | * | 11/1884 | Prescott | 33/437 |
| 329,392 | A | * | 10/1885 | Jordan | 33/437 |
| 1,094,041 | A | * | 4/1914 | Williams | 33/438 |
| 1,392,756 | A | * | 10/1921 | Gahan | 33/437 |
| 1,698,506 | A | * | 1/1929 | Norcross | 33/443 |
| 1,719,273 | A | * | 7/1929 | McAdam | 33/437 |
| 1,817,640 | A | * | 8/1931 | Newman et al. | 40/352 |
| 2,445,533 | A | * | 7/1948 | Mondron et al. | 33/443 |
| 2,512,821 | A | * | 6/1950 | Barber | 33/430 |
| 2,529,005 | A | * | 11/1950 | Erickson | 33/437 |
| 2,954,609 | A | * | 10/1960 | Goertz | 33/443 |
| 3,065,547 | A | * | 11/1962 | Blodgett et al. | 33/443 |
| 3,826,006 | A | | 7/1974 | Rushin | |
| 4,138,818 | A | | 2/1979 | Hebel | |
| 4,254,556 | A | * | 3/1981 | Anav | 33/437 |
| 4,380,124 | A | | 4/1983 | Smith | |
| D276,732 | S | | 12/1984 | Marquez | |
| 4,939,968 | A | * | 7/1990 | Stoof | 83/886 |
| 5,086,565 | A | * | 2/1992 | Cartwright | 33/430 |
| 5,337,484 | A | * | 8/1994 | Cardon | 33/41.2 |
| 5,343,625 | A | * | 9/1994 | Chen et al. | 33/403 |
| 5,845,409 | A | | 12/1998 | Kimoto | |

FOREIGN PATENT DOCUMENTS

| | | | | | |
|---|---|---|---|---|---|
| EP | 0399963 | A1 | * | 11/1990 | 33/443 |
| GB | 2070787 | A | * | 9/1981 | 33/438 |
| GB | 2153746 | A | * | 8/1985 | 33/432 |
| GB | 2345885 | A | * | 7/2000 | B43L/5/00 |

* cited by examiner

*Primary Examiner*—Christopher W. Fulton
*Assistant Examiner*—Mirellys Jagan
(74) *Attorney, Agent, or Firm*—Harleston Law Firm, LLC; Kathleen M. Harleston

(57) ABSTRACT

A portable drawing board device adapted for helping art students to draw perspective drawings, includes:

(a) a generally rectangular-shaped, flat drawing surface on an upper surface of the drawing board, the drawing surface being adapted for supporting a flat drawing substrate;

(b) a pair of parallel side grooves in an upper surface of the drawing board, each being parallel and adjacent to one of two opposite sides of the drawing surface, and extending the length of the drawing surface;

(c) a pair of first slide adjusters adapted for sliding up and down along the side grooves; and (d) a pair of movable pivot arms, each movably attached at one end to a slide adjuster;

wherein, when the first slide adjuster is in the side groove, the pivot arm extends over a portion of the drawing surface, and is adapted for assisting a user in drawing horizontal and diagonal lines on the drawing substrate.

15 Claims, 8 Drawing Sheets

PORTABLE DRAWING BOARD FOR ART STUDENTS

BACKGROUND OF THE INVENTION

1. Technical Field

The present device is a portable drawing board adapted for use by art students of all ages for drawing perspective drawings.

2. Background Information

Artists use various types of mediums, tools, and techniques to achieve desired effects. Artists who wish to create a sense of depth in their images most often use a technique called linear perspective. Linear perspective is based on the concept that an object in front of you would appear larger than an identical object located farther away. With linear perspective, lines that illustrate depth always converge to a vanishing point. For example, from the standpoint of the center of a highway extending straight ahead into the distance, the highway appears to have edges which converge at a central point. This central point is called the vanishing point.

Soon after they begin a drawing course, art students are taught the concept of linear perspective and the vanishing point. A vanishing point may be within the frame of the picture, such as in a landscape, or it may be outside the frame of the picture, as is often the case for a close-up of an object. Once they learn one-point perspective drawing, they are taught drawing from the two-point perspective. Many students have difficulty applying these concepts and achieving presentable perspective drawings. Artists and students use straight edges, such as rulers or triangles, to make their lines clean and precise. They may also use a drawing board for holding paper or the like while they draw. Even with these tools, though, it is difficult for many students to grasp these concepts and produce presentable drawings. Many art students, especially teenagers, dislike practicing and give up before they master the required techniques.

Although drawing boards are known, portable drawing boards that are adapted for helping art students to quickly and easily learn to draw perspective pictures are not. The drawing board of the present invention accomplishes this task, and enhances the quality and quantity of linear perspective drawings. The present drawing boards helps the student to learn one and two point perspective drawings, and can be used long after the student has moved on to more complex projects. It is also suitable for use by amateur and professional artists.

BRIEF SUMMARY OF THE INVENTION

The present invention is a portable drawing board device adapted for helping art students to draw perspective drawings, comprising:

(a) a generally rectangular-shaped, flat drawing surface on an upper surface of the drawing board, the drawing surface being adapted for supporting a flat drawing substrate;

(b) a pair of parallel side grooves in an upper surface of the drawing board, each being parallel and adjacent to one of two opposite sides of the drawing surface, and extending the length of the drawing surface;

(c) a pair of first slide adjusters adapted for sliding up and down along the side grooves; and (d) a pair of movable pivot arms, each movably attached at one end to a slide adjuster;

wherein, when the first slide adjuster is in the side groove, the pivot arm extends over a portion of the drawing surface, and is adapted for assisting a user in drawing horizontal and diagonal lines on the drawing substrate. Variations of the sliding adjuster are also included herein, including an adjuster with a tack at the bottom for fixing along a side groove, and an adjuster with a hollow bottom which fits over pegs on the side groove.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
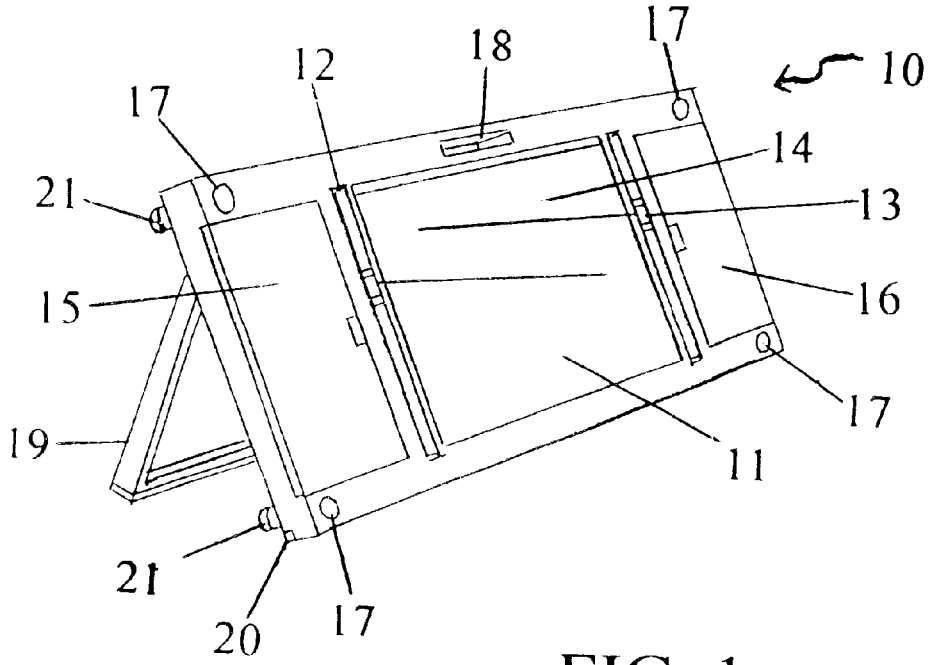
FIG. 1 shows a front perspective view of a drawing board according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring to FIG. 1, a portable drawing board is illustrated, generally designated 10, which is constructed in accordance with the present invention. The drawing board of the present invention helps art students of any age to understand and apply the concepts of linear perspective. The drawing board 10 comprises a smooth, flat, rectangular-shaped drawing surface 11 in the center of the front of the board. The drawing surface has an upper side, a lower side, a left side, and a right side. The drawing surface 11 is magnetic in the preferred embodiment, but may be made of other materials, such as plastic. To use the drawing board, the user places the paper or other flat drawing surface on the drawing area. The drawing sheet can be held on the drawing surface by means of small magnets placed at the four corners of the paper, or conventional sealing tape, or clips and/or fasteners may be included along the sides of the drawing surface for securing the drawing sheet.

Continuing with FIG. 1, the drawing board includes a pair of identical, parallel side grooves 12 in an upper surface of the drawing board. These side grooves are parallel to and beside the left and right sides of the drawing surface, and extend the length of the drawing surface. First slide adjusters 13, preferably adjustable "two-point" adjusters, are inserted in the side grooves 12. A pair of movable pivot arms 14 are attached to the two-point adjusters. Each pivot arm 14 is movably attached at one end to a two-point adjuster 13 in a side groove 12. The pivot arms have straight edges. The user can slide the adjusters 13 vertically up and down the side grooves 12 in order to move the pivot arms 14 to a desired position. These positions allow the user to draw horizontal and diagonal lines anywhere on the drawing surface 11. The pivot arms assist the user to draw lines straight across the drawing page (horizontally) or at an angle up or down the drawing page toward two vanishing points, which are usually along the right and left sides of the page along the same line (latitude). The right-hand pivot arm assists the user in drawing lines along the right side of the drawing page, and the left-hand pivot arm assists in drawing lines along the left side of the drawing page. These pivot arms help the user to draw, or learn to draw, from a two-point perspective.

Figure 2:
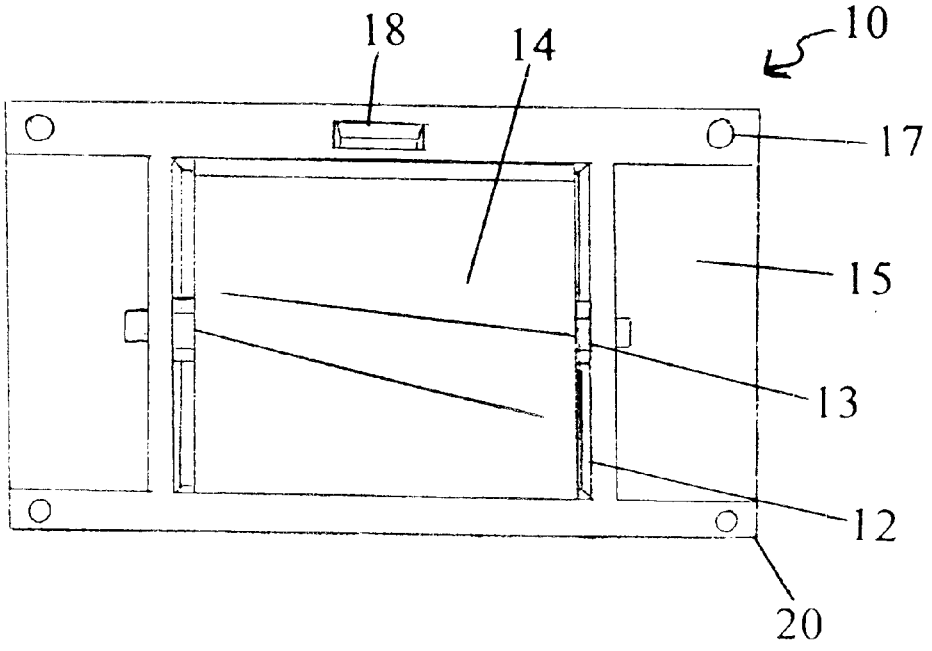
FIG. 2 is a front elevational view of a drawing board according to the present invention.

Referring to FIGS. 1 and 2, storage compartments 15 are located outside the drawing surface on the left and/or right of the drawing board. They have compartment doors 16 to prevent stored items from falling out while the drawing board 10 is in use. Four circular stacking depressions 17 are located at the four corners of the drawing board 10 to allow stacking of multiple drawing boards for storage and transport.

A handle 18 is located at the top so that a drawing board can be carried easily, for example, from a classroom to a drawing location, as shown in FIGS. 1 and 2. The handle is preferably a rectangular hole in the center of the drawing board along its upper edge. A user's fingers can be placed through the hole so an individual drawing board can be carried like a toolbox. Alternatively, the handle could fold-out so that it could be pulled up to carry the drawing board like a briefcase.

Continuing with FIGS. 1 and 2, the bottom surface of the drawing board has an adjustable stand 19. The stand can be collapsed so that the drawing board can be used in a substantially horizontal position (flat) on a table or desk surface, or the stand can be pulled out so the drawing board can be used in a raised, or more vertical, position, as shown in FIG. 1. The latter is useful where the artist is drawing a scene or an object at shoulder-level. The stand 19 may be adjustable so that the board leans at various angles between the horizontal and near vertical positions. The bottom rear edge 20 of the drawing board is preferably made of or covered with rubber or the like to prevent the board from sliding while it is in use in the raised position. The legs 21 have rubber tips to prevent sliding while the drawing board 10 is in use in the horizontal position shown in FIG. 2.

Figure 3:
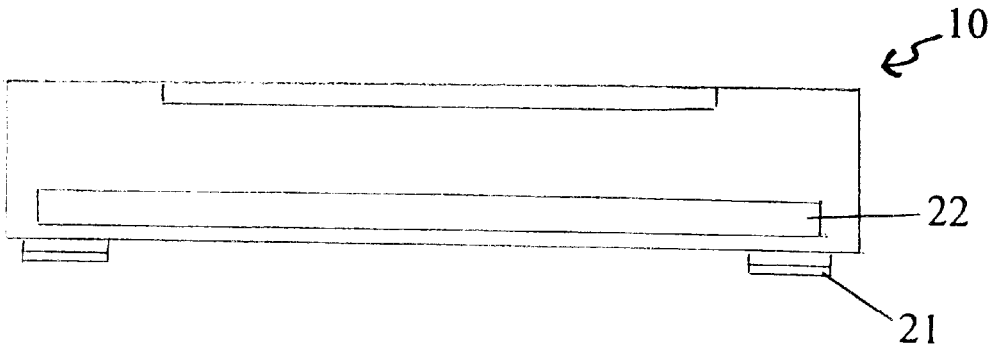
FIG. 3 is a top plan view of a drawing board according to FIG. 2.

Referring to FIG. 3, the drawing board can include a paper storage area or tray 22, in a rectangular recess parallel to the lower surface of the board. The tray 22 may be pulled out for easy access to stored paper while using the drawing board 10.

Figure 4:
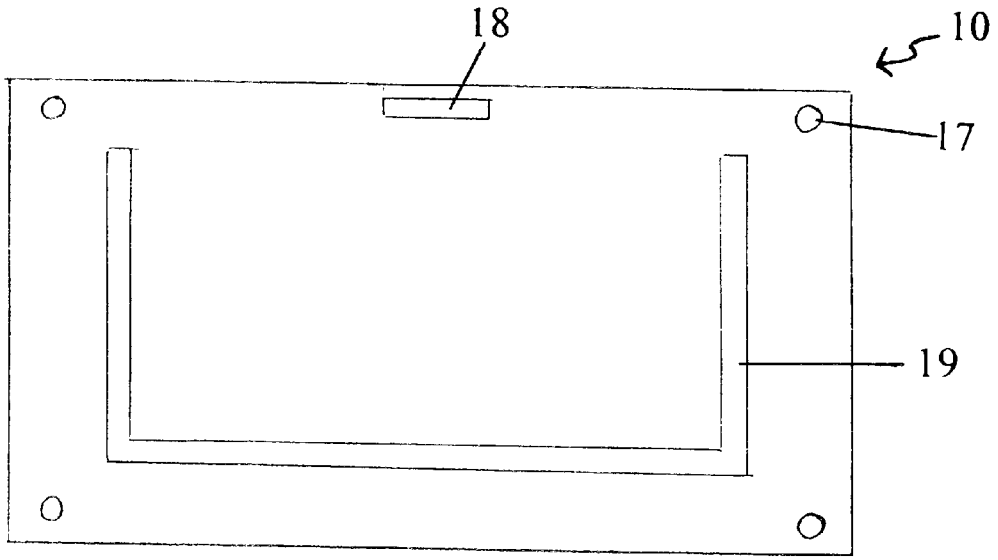
FIG. 4 is a rear elevational view of a drawing board according to FIG. 2.

As shown in FIG. 4, the rear of the drawing board includes the handle 18, the adjustable stand 19, and the rubber-tipped legs 21. The upper two legs 21 on the drawing board are preferably slightly higher than the lower two legs, so the drawing board tilts slightly when it is flat, on a table top for example, to make it easier to draw. Alternatively, the drawing board could have no legs, or two upper legs and no lower legs. The stand is shown in a collapsed position.

Figure 5:
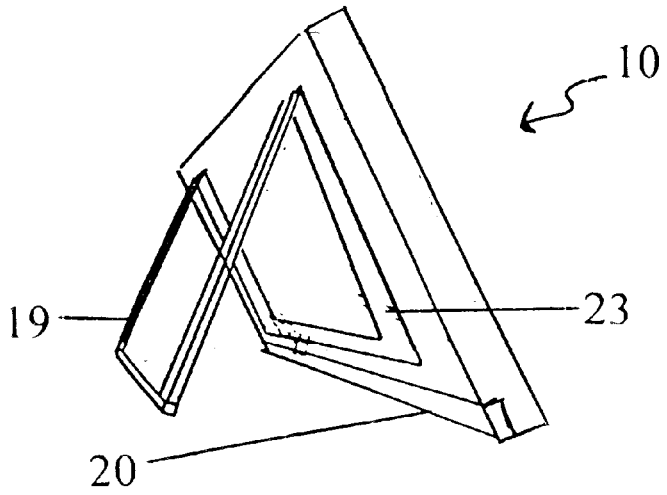
FIG. 5 is a rear perspective view of a drawing board according to the present invention.

Referring to FIG. 5, the stand 19 can be opened and adjusted so that the drawing board is ready for use at an angled position. The adjustable stand 19 fits flush into a like-shaped recess 23 in the rear of the drawing board. The bottom rear edge 20 of the drawing board and the base of the stand are preferably made of or covered with rubber or the like to prevent the board from sliding while it is in use in the raised position.

Figure 6:
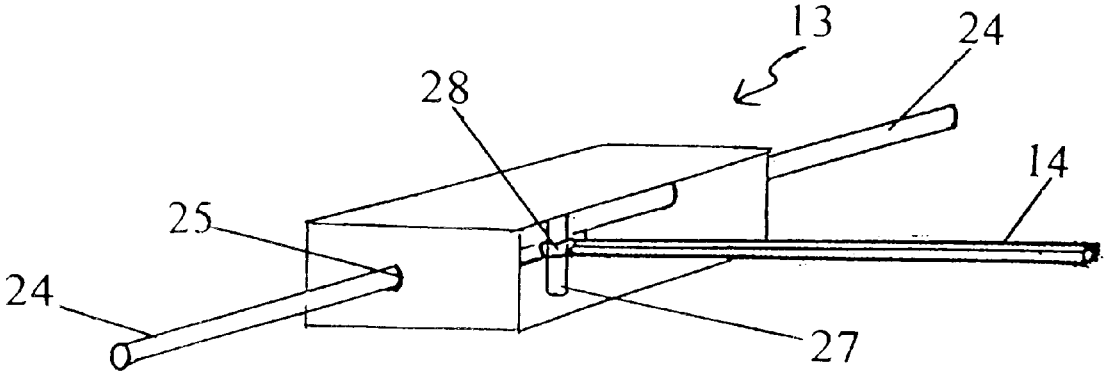
FIG. 6 is a perspective view of the two-point adjuster as shown in FIG. 2.
Figure 7:
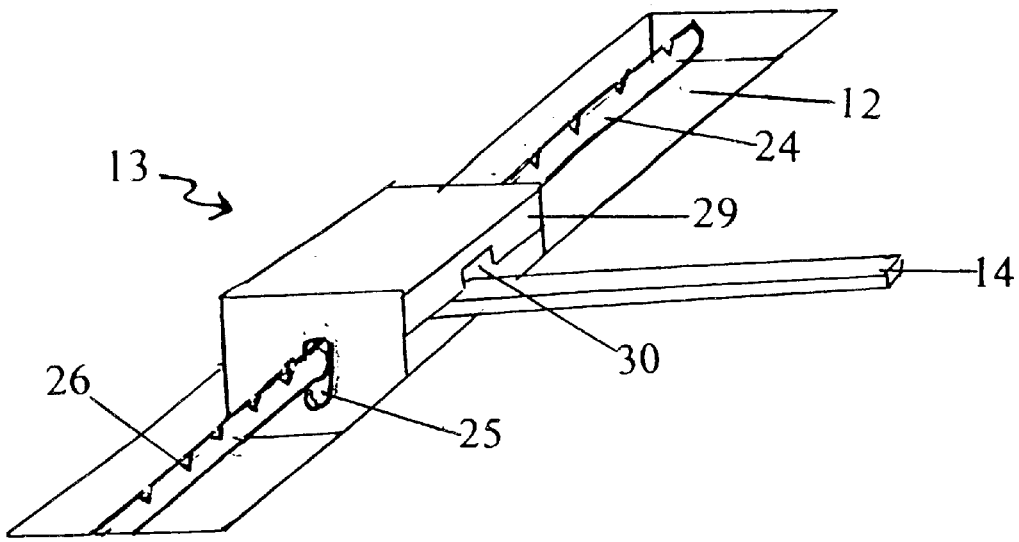
FIG. 7 is a perspective view of a second alternate embodiment of a two-point adjuster according to the present invention.

FIG. 6 illustrates a rectangular-shaped two-point adjuster 13, and FIG. 7 shows an alternate embodiment of a two-point adjuster in a side groove 12. An adjuster 13 is preferably about the size of a simple pencil sharpener. Each adjuster fits closely in a side groove 12, which is preferably only slightly wider than the adjuster. The adjuster in FIG. 6 is shown outside of the side groove for the purposes of illustration.

As shown in FIGS. 6 and 7, a rod 24 extends horizontally through the two-point adjuster 13 from one end of the side groove 12 to the other. The side groove has been shortened in FIG. 7 for the purposes of illustration. The rod 24 extends closely through an aperture 25 in both ends of the adjuster. To use the drawing board for drawing two-point perspectives, the user grasps a two-point adjuster 13 at both ends, usually between the thumb and forefinger. The user then lifts slightly, and pushes the adjuster up or down along the rod. The rod 24 may have a series of notches 26, which are preferably V-shaped and the same size as each other, along its upper surface, as shown in FIG. 7. When the user releases the adjuster at the desired location along the side groove, gravity causes the adjuster to drop down on the rod. When this occurs, the top edges of each aperture 25 settle into an notch along the rod. The user repeats this procedure for the adjuster on the opposite side of the drawing surface. This notch mechanism holds the adjusters in place until the next time they are moved. Alternate mechanisms for sliding the adjusters are included herein, such as buttons on either end of the adjuster which can be depressed to move the adjuster up and down along the side groove.

As shown in FIG. 6, there is also a short pivot post 27 extending vertically across the inside of the adjuster at its center. The pivot post extends through the center of an eye 28 formed at the end of the pivot arm 14. The pivot post 27 allows the pivot arm to swing up or down across the drawing sheet. The user swings the pivot arm 14 into a desired position, then uses the pivot arm as a guide to draw diagonal lines on the drawing sheet. When the pivot arm is placed at a ninety degree angle to the side of the drawing surface, it can be used to draw a straight horizontal line. Only a portion of the pivot arms 14 have been shown in FIGS. 6–8. Other mechanisms may be employed herein for swinging the pivot arm.

Thus, the first slide adjusters fit down into the side grooves; each pivot arm is movably attached to a central post extending vertically within the first slide adjuster; each pivot arm has an eye at the end that is attached to the first slide adjuster; and each adjuster post fits through an eye in the pivot arm. This is so the pivot arm will sweep across the drawing page like a windshield wiper.

In the embodiment illustrated in FIG. 7, the side of the adjuster has a cover 29 extending lengthwise along approximately half of the width of the adjuster. The bottom of the adjuster side cover has an indentation 30 which matches the rectangular shape of the pivot arm. When the pivot arm is lifted into the indentation 30, the pivot arm 14 cannot move at an angle and is held in a horizontal position.

The pivot arm 14 is preferably thin, and of the same width and thickness. It should be wide enough to function as a straight edge, but not so wide as to interfere with the space on the drawing sheet, or to smear the drawing medium on the sheet. Smearing is especially a problem when lead or chalk is the drawing medium. The pivot arm should be thick enough to be grasped and moved without breaking with repeated usage, but not so thick that it interferes with the drawing process. The pivot arms are preferably equal in length. Each pivot arm 14 extends approximately ¾ of the length of the drawing surface 11.

Figure 8:
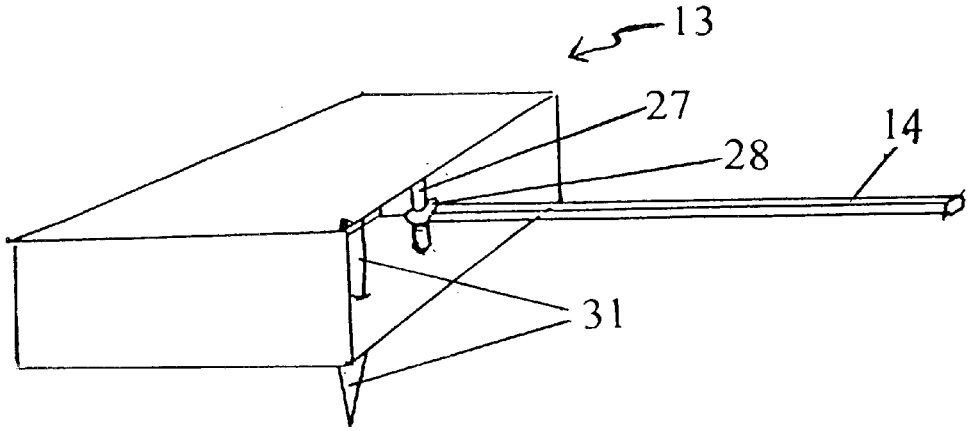
FIG. 8 is a perspective view of a third alternate embodiment of a two-point adjuster according to the present invention.

Referring to FIG. 8, an alternate embodiment of the two-point adjuster 13 includes a sharp tack 31 extending from the bottom of the adjuster in the approximate center. This adjuster embodiment does not require rods or side grooves. Instead, the two-point adjuster is placed in the desired position by sticking the tack 31 into corkboard or the like on a straight, marked track along the sides of the drawing surface. It can then be used the same way as the other embodiments. The grooves or marked track are preferably marked in one inch increments, so that the user can recall a previous location of the adjuster.

Figure 9:
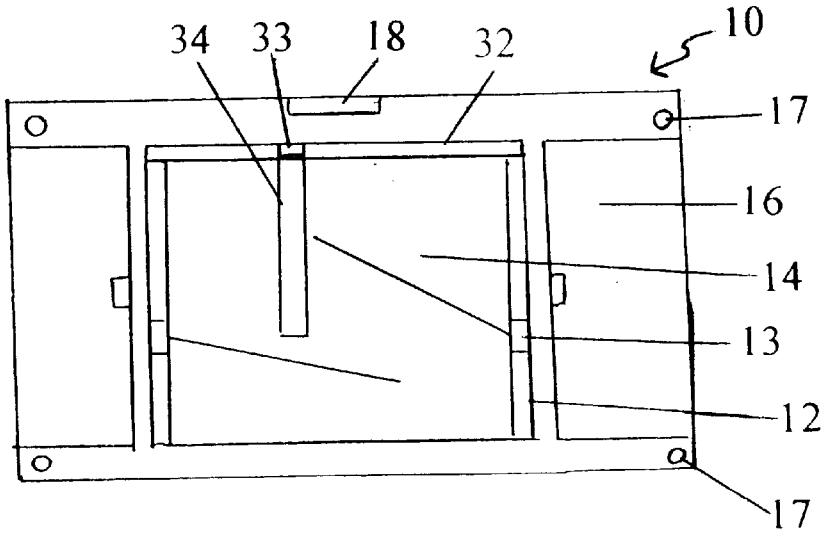
FIG. 9 is a front elevational view of a second alternate embodiment of a drawing board according to the present invention.

Referring to FIG. 9, a second alternate embodiment of the drawing board includes side grooves 12 with adjusters 13 and pivot arms 14 for drawing horizontal and diagonal lines. It also includes a straight edge for drawing vertical lines on the drawing sheet. The drawing board 10 has an upper groove 32 which runs parallel to and abuts the upper side of the drawing surface 11. Like the side grooves 12, the upper groove 32 extends the length of the drawing surface. A slideable vertical adjuster, also called here a second slide adjuster 33, which is attached to a vertical arm 34, fits into the upper groove. The vertical arm extends down across the upper portion of the drawing sheet. A user can slide the vertical adjuster back and forth along the upper groove and use the vertical arm to draw vertical lines along the upper portion of the drawing sheet.

Figure 10:
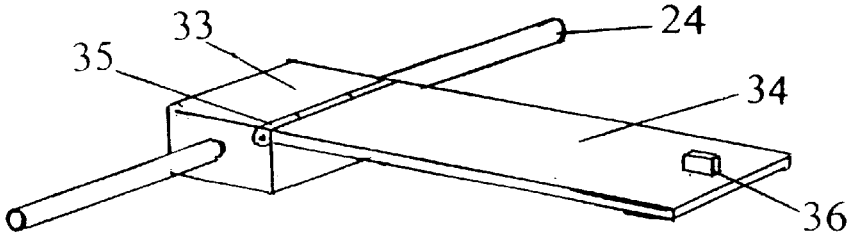
FIG. 10 is a perspective view of a third, hinged arm as shown in FIG. 9.

As shown close-up in FIG. 10, a rod 24 extends through the vertical adjuster 33. The rod 24 is affixed to the inside ends of the upper groove 32. The vertical adjuster 33 is seated in the upper groove and is adapted to slide back and forth along the rod 24 in the upper groove. The end of the vertical arm 34 is affixed to the vertical adjuster by a hinge 35, so that the vertical arm can be lifted off the surface as desired. When the vertical arm 34 is up, it does not interfere with the drawing surface. The vertical arm can also be cleaned when it is in the "up" position, which should decrease the amount of smudging on the drawing sheet. The opposite end of the vertical arm can be flared up, or it can have a small knob 36 on its upper surface, to facilitate the lifting of the vertical arm. The hinge can be spring loaded, although a simple hinge will suffice. Gravity will cause the vertical arm on a simple hinge to stay up once the vertical arm is pushed past ninety degrees from the drawing surface. If desired, a magnet on the bottom surface of the free end of the vertical arm can be used instead of or in addition to, a hinge. The magnet will be attracted to the magnetic drawing surface, which will hold the vertical arm down on the drawing sheet. A small magnet can easily be attached to or detached from the drawing surface, even through the drawing sheet.

Thus, the vertical arm has a "down", ready position over the drawing surface for use, and a bent, "up" position away from the drawing surface for keeping the arm out of the way or for cleaning the vertical arm.

Figure 11:
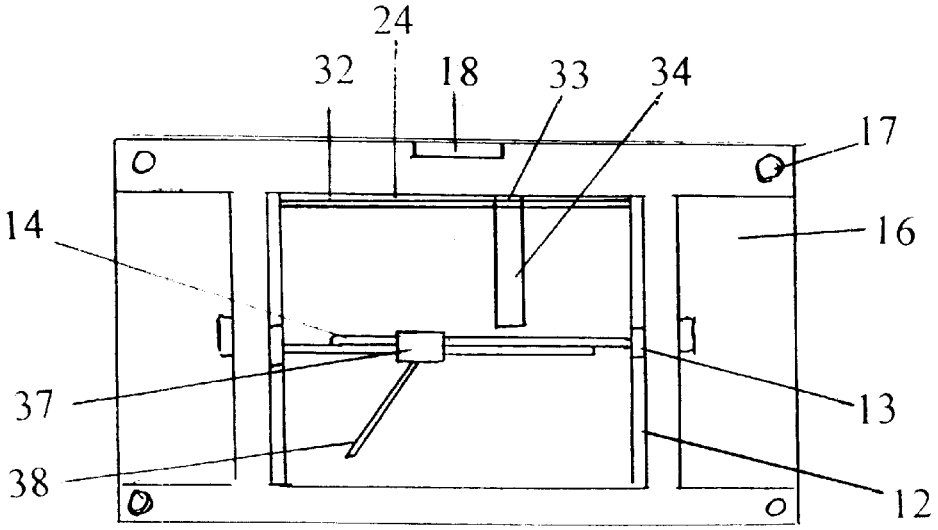
FIG. 11 is a front elevational view of a third alternate embodiment of a drawing board according to the present invention.

Referring to FIG. 11, a third alternate embodiment of the drawing board includes side grooves 12 with two-point adjusters 13 and pivot arms 14 for drawing horizontal and diagonal lines from a two-point perspective, as well as an upper groove 32, a vertical adjuster 33, and a vertical arm 34 for drawing vertical lines. This embodiment also includes a one-point adjuster, also called here a third slide adjuster 37, and an associated circular arm 38 adapted for drawing vertical, horizontal, and diagonal lines from a one-point perspective anywhere along the drawing sheet. When the artist user wishes to draw from a one-point perspective, he or she adjusts the pivot arms 14 and aligns them horizontally across the drawing sheet at a desired location. The one-point adjuster 37 is then placed over the pivot arms and slid to the desired vanishing point. The movable circular arm 38 extends from the bottom of the one-point adjuster 37 and can be used to draw lines from the vanishing point.

Figure 12:
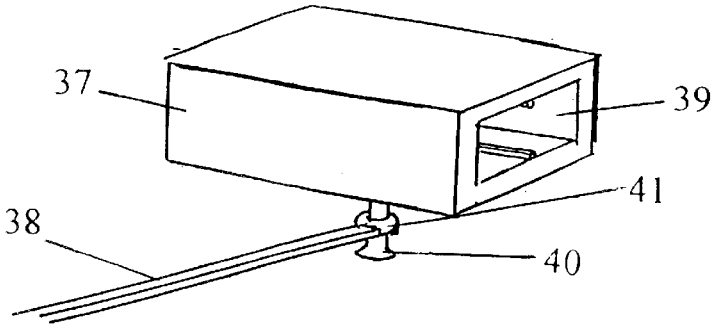
FIG. 12 is a perspective view of the top of the two-point adjuster shown in FIG. 11.
Figure 13:
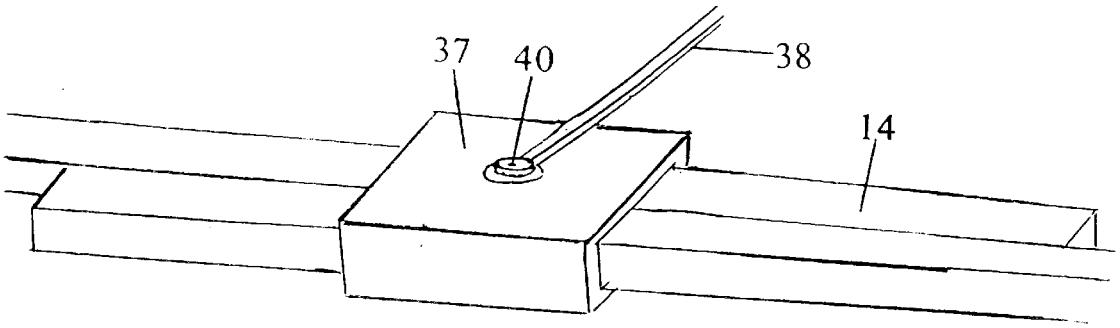
FIG. 13 is a perspective view of the bottom of the two-point adjuster and pivot arms shown in FIG. 11.

With reference to FIGS. 12 and 13, a one-point adjuster 37 is shown right side up without pivot arms in FIG. 12, and upside down with pivot arms in FIG. 13. The rectangular-shaped one-point adjuster 37, which is approximately the size of a simple pencil sharpener and slightly wider than the side by side pivot arms, has two tracks 39 along its interior for holding the pivot arms 14. The pivot arms 14 can be held in place in the side cover indentations 30 of the two-point adjusters 13, as shown in FIG. 7. Once the pivot arms have been placed through the center of the one-point adjuster, as shown in FIG. 13, the one-point adjuster can be moved back and forth horizontally along the temporarily fixed pivot arms. A short post 40 extends from the center bottom surface of the one-point adjuster. In FIG. 12, for the purposes of illustration, the one-point adjuster post 40 is shown larger than is required. The circular arm has an eye 41 at its end which circles the one-point adjuster post. The circular arm 38 can be rotated 360 degrees around the bottom of the one-point adjuster 37, as shown in FIG. 13, for drawing vertical, horizontal, and diagonal lines from the centerpoint, which is the vanishing point of the picture.

The drawing board is preferably sized to fit comfortably on an adult's lap or on a student desk. Regarding preferred measurements, the drawing board 10 is between about 18 and 48 inches in length, about 12 and 36 inches in height, and about ½ and 4 inches wide. Most preferably, the board is about 30–40 inches long, 20–28 inches high, and 1–2 inches wide. The flat drawing surface 11 is preferably between about 12 and 36 inches long, and about 12 and 24 inches wide. The upper two legs 21 (at the top of the board) are between about 1 and 2 inches in height, and the bottom two legs 21 are between about ¼ and 1 inch in height. The pivot arms 14, vertical arm 34, and circular arm 38 are preferably between about 6 and 10 inches in length, about ⅛ and ½ inch in height, and about ⅛ and ¼ inch in width (thickness). The two-point adjusters 13, vertical adjuster 33, and one-point adjuster 37 are preferably between about ½ and 2 inches in length, about ¼ and 2 inches in height, and about ¼ and 1 inch in width. The storage compartments 15 are preferably about 4 inches by 18 inches.

Figure 14:
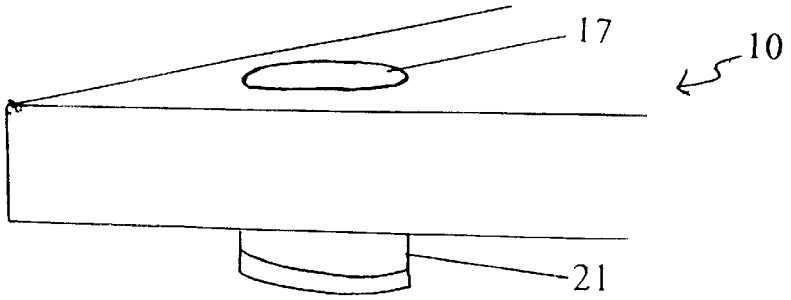
FIG. 14 is an expanded, perspective view of the leg area of the drawing board shown in FIG. 11.

Referring to FIG. 14, a corner of the drawing board includes a stacking depression 17, and a rubber-tipped leg 21. The depression 17 is actually a hollow at the top of the leg 21. The legs and depressions are preferably molded into the body of the drawing board, which is preferably made of plastic. Each leg fits closely into the depression of another drawing board, allowing multiple drawing boards to be stacked. When the boards are stacked, the four short, circular legs 21 of one drawing board fit closely into the four circular depressions 17 of the drawing board directly below. This facilitates, for example, transport of a stack of drawing boards by an art teacher to a classroom. Preferably, the upper and lower surfaces of the drawing board are relatively flat, and the legs and depressions are of such a height and depth, respectively, that there is little space between the drawing boards when they are stacked. Alternatively, the compartments on either side of the drawing board can be higher than the rest of the upper surface, so that the lower surface of the board above can be stacked on the compartment doors of the board below in a stack of drawing boards. The rubber tips on the legs 21 prevent the drawing board from slipping when the drawing board is used in the horizontal position, e.g., flat on a desk top.

Figure 15:
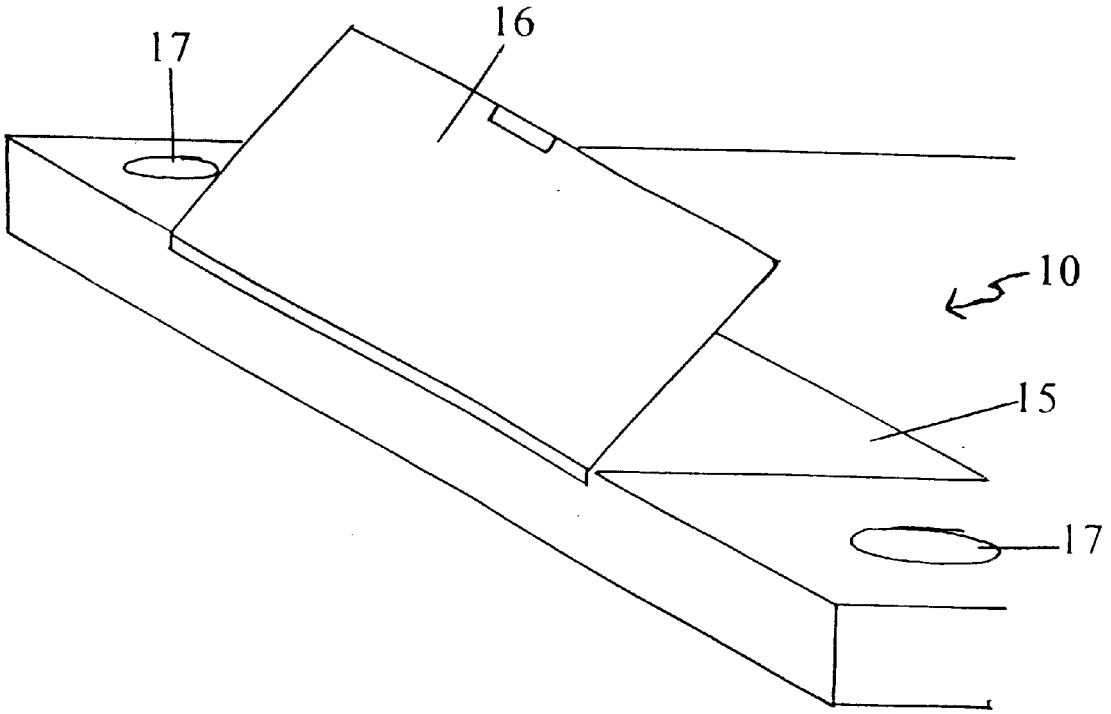
FIG. 15 is an expanded, perspective view of the side of the drawing board shown in FIG. 11.

FIG. 15 is a close-up view of a storage compartment 15 with the door 16 partially open. An assortment of conventional drawing supplies may be stored in the two storage compartments, including pens, pencils, erasers, chalk, magnets, triangles, and protractors. The adjusters and arms may be stored in the storage compartments when they are not in use. Each storage compartment may consist of a single, undivided area, or it be divided into sections to aid in organization of the stored materials.

Figure 16:
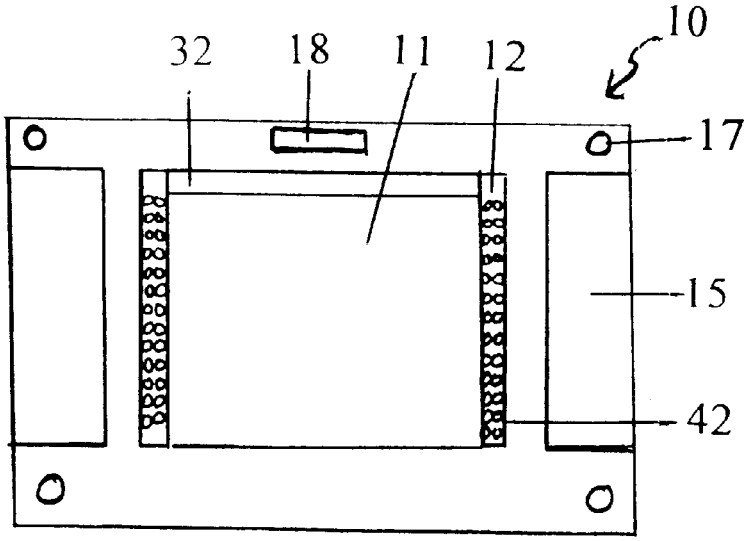
FIG. 16 is a front elevational view of a fourth alternate embodiment of a drawing board according to the present invention.

Referring to FIG. 16, a fourth embodiment of the drawing board 10, which is shown without adjusters or arms, has a plurality of like-sized two-point adjuster pegs 42 lined up along the side grooves 12. The adjuster pegs 42 are preferably lined up in pairs along each side groove. In this embodiment, the side grooves 12 can be a few centimeters deep, or flat, i.e., flush with the drawing surface 11. The adjuster pegs 42 preferably rise a few centimeters off the bottom surface of the groove.

Figure 17:
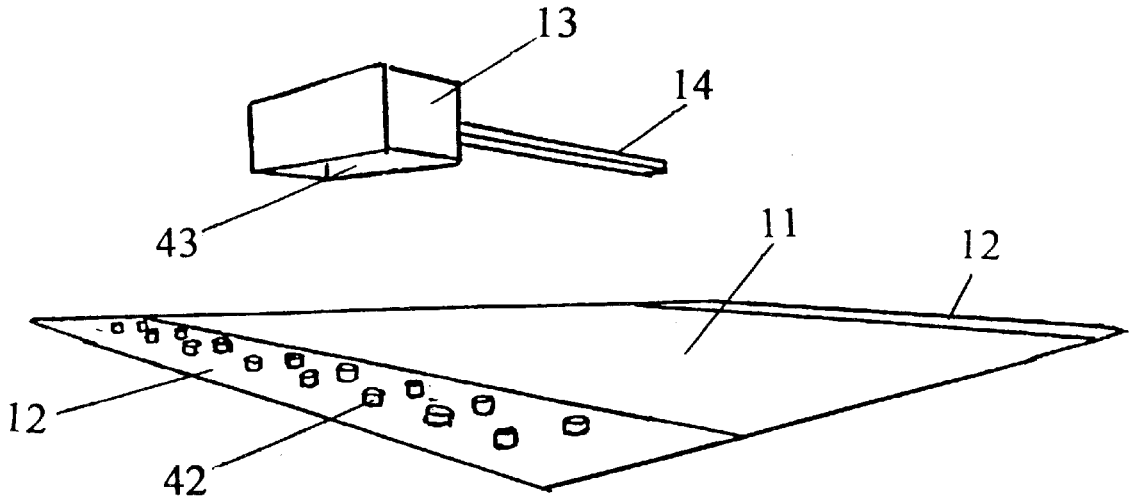
FIG. 17 is a perspective view of the drawing board shown in FIG. 16.

FIG. 17 shows a two-point adjuster 13 with a pivot arm 14 extending from it. The adjuster 13 is suspended above pegs 42 in a side groove 12. The side grooves 12 border the drawing surface 11. The drawing board has been simplified in FIG. 17 for purposes of illustration. As shown in FIG. 17, each adjuster 13 is open at the bottom 43. The open bottom face 43 of the adjuster 13 fits closely over any four adjacent pegs 42. Each peg has a diameter which is slightly less than half the width of the two-point adjuster 13. Thus, a two-point adjuster fits tightly over four side by side pegs. This is an alternative to having the adjuster 13 slide along a rod in the side groove. The adjuster 13 would still have a central pivot post or the like for supporting the movable pivot arm 14. The artist user chooses where to place the two-point adjuster based on where the vanishing point is on the drawing surface. The other two-point adjuster is placed at a corresponding location in the opposite side groove. The two-point adjusters are easy to fix in place and remove. Once the adjuster 13 is fixed in place, it holds the pivot arm 14 steady so the artist can use the arm to draw straight lines towards the selected vanishing point.

From the foregoing it can be realized that the described device of the present invention may be easily and conveniently utilized. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A portable drawing board device for assisting in the drawing of perspective drawings, comprising:

(a) a generally rectangular-shaped, flat drawing surface on an upper surface of the drawing board, the drawing surface being adapted for supporting a flat drawing substrate;

(b) a pair of parallel side grooves in an upper surface of the drawing board, each being generally parallel and adjacent to one of two opposite edges of the drawing surface, and extending substantially the length of the drawing surface;

(c) a pair of removable first slide adjusters, each slidably affixed in an opposite one of the side grooves;

(d) a pair of movable pivot arms, each movably attached at one end to a different one of the first slide adjusters;

(e) at least one upper groove on the upper surface of the drawing board, the upper groove being generally parallel and adjacent to the upper side of the drawing surface, generally perpendicular to the side grooves, and extending substantially the length of the upper side of the drawing surface;

(f) a second slide adjuster slidably engaged in the upper groove; and (g) a vertical arm movably attached at one end to the second slide adjuster;

wherein the vertical arm is extendible over a portion of the drawing surface;

wherein the second slide adjuster is movable back and forth along a rod extending within the upper groove, the ends of the upper groove rod ending at and being attached to opposite ends of the upper groove above the bottom of the upper groove;

wherein each of the pivot arms extend over a portion of the drawing surface from opposite sides of the drawing surface, and the pivot arms are adapted for assisting in drawing horizontal and diagonal lines on the drawing substrate;

wherein a rod extends the length of each side groove above the bottom of the side groove, the rod having opposite ends, each being attached to and ending at an opposite end of each side groove; and wherein each of the rods extends through an aperture in each of the first slide adjusters; and each of the first slide adjusters is independently slidable along the rod; and wherein the drawing board device further comprises a one-point adjuster and a circular arm for drawing vertical, horizontal and diagonal lines from a one-point perspective, wherein the one-point adjuster, which is not a protractor, movably encircles the two pivot arms when the two pivot arms are in an adjacent position, and is slidable along both of the adjacent pivot arms simultaneously; and wherein the circular arm comprises a straight edge, is movably attached at one end to the one-point adjuster, and is extendible in a circular direction around the one-point adjuster.

2. A drawing board device according to claim 1, wherein the first slide adjusters are not connected to one another by a straight edge.

3. A drawing board device according to claim 1, wherein the attached end of the vertical arm is hinged to one side of the second slide adjuster, and the vertical arm has a down position adjacent to the drawing surface, and an alternate, up position away from the drawing surface.

4. A drawing board device according to claim 1, wherein the pivot arms are elongated and generally rectangular in shape, and wherein upper and lower sides of the pivot arms are straight edges.

5. A drawing board device according to claim 4, wherein each of the first slide adjusters is slidably received in one of the side grooves; a central post extending vertically within each of the first slide adjusters; each pivot arm comprising an eye at the end that is attached to the first slide adjuster; and each eye receiving therethrough one of the central posts.

6. A drawing board device according to claim 5, further comprising molded legs on two or four corners of the generally flat lower surface of a first drawing board; circular hollows in the tops of the legs being accessible from the upper surface of the first drawing board, each leg of a second drawing board being closely fitable into the corresponding leg hollow of the first drawing board, wherein the second drawing board is stackable on top of the first drawing board.

7. A drawing board device according to claim 1, wherein the drawing surface is magnetized.

8. A drawing board device according to claim 7, further comprising a collapsible mechanism for maintaining the drawing board in an upright position.

9. A drawing board device according to claim 8, wherein the collapsible mechanism is an adjustable stand on a lower surface of the drawing board.

10. A drawing board device according to claim 9, further comprising a recessed handle along the top of the drawing board.

11. A drawing board device according to claim 9, further comprising a storage compartment on each side of the drawing board.

12. A portable drawing board device for guiding perspective drawing, comprising:

(a) a generally rectangular-shaped, flat drawing surface on an upper surface of the drawing board;

(b) a pair of parallel side grooves in an upper surface of the drawing board, each being generally parallel to and adjacent to one of two opposite sides of the drawing surface and extending the length of the drawing surface;

(c) a pair of removable block adjusters;

(d) a pair of pivot arms, each movably attached at one end to one of the block adjusters;

(e) a plurality of like-sized adjuster pegs protruding from the surface of the side grooves; and wherein each block adjuster is open at the bottom and is receivable over one of the adjacent adjuster pegs for fixing the block adjusters onto the side grooves; and wherein the pivot arms are movable along the drawing surface.

13. A drawing board device according to claim 12, further comprising:

(f) at least one upper groove on the upper surface of the drawing board, the upper groove being generally parallel and adjacent to the upper side of the drawing surface, generally perpendicular to the side grooves, and extending substantially the length of the upper side of the drawing surface;

(g) a second slide adjuster slidably engaged in the upper groove; and (h) a vertical arm movably attached at one end to the second slide adjuster;

wherein the vertical arm is extendible over a portion of the drawing surface.

14. A drawing board device according to claim 13, wherein the second slide adjuster is movable back and forth along a rod extending within the upper groove, the ends of the upper groove rod ending at and being attached to opposite ends of the upper groove above the bottom of the upper groove.

15. A portable drawing board device for guiding perspective drawing, comprising:

(a) a substantially flat, generally rectangular-shaped drawing surface comprising an upper side, a lower side, a left side, and a right side;

(b) a pair of substantially identical, parallel, tack-receiving side grooves in an upper surface of the drawing board generally parallel and adjacent to the left and right sides of the drawing surface, and extending substantially the length of the drawing surface;

(c) a pair of first slide adjusters, each first slide adjuster comprising a tack, the tack comprising a sharp end, the sharp end protruding from a bottom face of the first slide adjuster; and (d) a pair of pivot arms, each movably attached at one end to one of the first slide adjusters; and wherein each first slide adjuster is detachably affixable along a side groove; and wherein the pivot arms are adapted for use in drawing horizontal and diagonal lines on a drawing sheet pinned on the drawing surface.

* * * * *